United States Patent [19]

Fleishman

[11] Patent Number: 4,569,496

[45] Date of Patent: Feb. 11, 1986

[54] PORTABLE FURNITURE

[76] Inventor: Gregg Fleishman, 6071 Hargis St., Los Angeles, Calif. 90034

[21] Appl. No.: 335,065

[22] Filed: Dec. 28, 1981

Related U.S. Application Data

[60] Division of Ser. No. 123,903, Feb. 22, 1980, Pat. No. 4,390,204, which is a continuation-in-part of Ser. No. 866,837, Jan. 4, 1978, Pat. No. 4,202,581.

[51] Int. Cl.[4] ..... A47B 3/06

[52] U.S. Cl. ..... 248/165; 248/174; 248/188; 248/188.1; 108/153; 403/231

[58] Field of Search ..... 248/188.1, 188.6, 165, 248/174, 150, 188; 108/153, 154, 155, 156, 157, 161; 46/15; 297/442; 403/231; 52/645

[56] References Cited

U.S. PATENT DOCUMENTS

| | | | |
|---|---|---|---|
| 352,328 | 11/1886 | Kaufhold | 248/188 |
| 2,643,046 | 6/1953 | Humphreys | 248/110 |

FOREIGN PATENT DOCUMENTS

| | | | |
|---|---|---|---|
| 94598 | 1/1963 | Denmark . | |
| 1204682 | 1/1960 | France | 403/231 |
| 6405529 | 11/1964 | Netherlands | 248/188.1 |

*Primary Examiner*—J. Franklin Foss
*Assistant Examiner*—Robert A. Olson
*Attorney, Agent, or Firm*—Lyon & Lyon

[57] ABSTRACT

There is disclosed improved portable furniture generally comprising planar one-piece support members having integral portions adapted to be resiliently disposed and releasably secured in angular relationship to each other allowing for support, said portable furniture returning to its planar configuration when the said members are disengaged to facilitate portability.

3 Claims, 8 Drawing Figures

PORTABLE FURNITURE

This is a division of application Ser. No. 123,903, filed Feb. 22, 1980, now U.S. Pat. No. 4,390,204, issued June 28, 1983, which is a continuation-in-part of application Ser. No. 866,837, filed Jan. 4, 1978, now U.S. Pat. No. 4,202,581, issued May 13, 1980.

BACKGROUND OF THE INVENTION

The improved portable furniture is constructed in such a manner as to optimize portability, aesthetic design, engineering practicality, simplicity of manufacture and comfort. The furniture is constructed to enable easy storage and facility of transportation, by allowing it to be disassembled and stored into a generally planar stack. This general type of furniture construction is also illustrated in the co-pending parent application, Ser. No. 866,837, filed Jan. 4, 1978, which is referred to above and incorporated herein by reference.

The present invention claimed comprises an improvement of this inventor's co-pending application in that in the chair embodiment resilient arm and seat portions are integrally formed into the one piece generally-planar support member which provides added comfort and support for the furniture. In the table embodiment, frame members are provided so that the support members can be interlocked and connected thereto, without utilizing retainer bars or connectors in the table top. This configuration provides added support, and allows for use with a wide variety of table tops. This is further described in the following Summary of the Invention.

SUMMARY OF THE INVENTION

The present invention relates to improved portable furniture which can be easily assembled and disassembled for facile storage. While being practical, the design of the herein disclosed portable furniture is not only comfortable, aesthetically pleasing, but is of an efficient design which minimizes the problems of prior art foldable or portable furniture.

The advantages of the present invention are obtained by forming a generally planar one piece support member from a suitable material preferably birch plywood, which support member includes, as an integral part thereof, a tab member, seat member and arm members, adapted to be resiliently disposed in angular relation relative to each other to allow support or portable furniture, which in preferred embodiments comprise portable chairs and portable tables.

For portable chairs, in the first embodiment, the support member is provided with an integral main, tab, leg and arm portions which are adapted to be resiliently disposed in angular relationship, then releasably secured in such position by interlocking means. In this embodiment the tab members also act as a chair seat and back for support of person seated therein. By releasing the interlocking means the furniture member returns to its planar configuration for ease of portability.

In the second portable chair embodiment, the support member is provided with means to enable a chair seat to be releasably secured to the support member when it is disposed in its angularly displaced mode.

Finally, in the embodiment encompassing portable tables, support members are releasably coupled with frame members which are simultaneously held together and supported by the same. These support members are, generally planar one-piece members comprising of a main portion and an integral tab portion which can be displaced and maintained in an angular relationship while engaging and supporting the interlocking frame members.

It can be appreciated that the table and chair configurations are comprised of interlocking members which are selectively separable for portability by disengaging interlocking means which hold the support members in angularly displaced modes.

BRIEF DESCRIPTION OF DRAWINGS

A more thorough disclosure of the features of the present invention is set out in the detailed descriptions of the drawings which are described below.

DETAILED DESCRIPTION OF THE INVENTION

Figure 1:
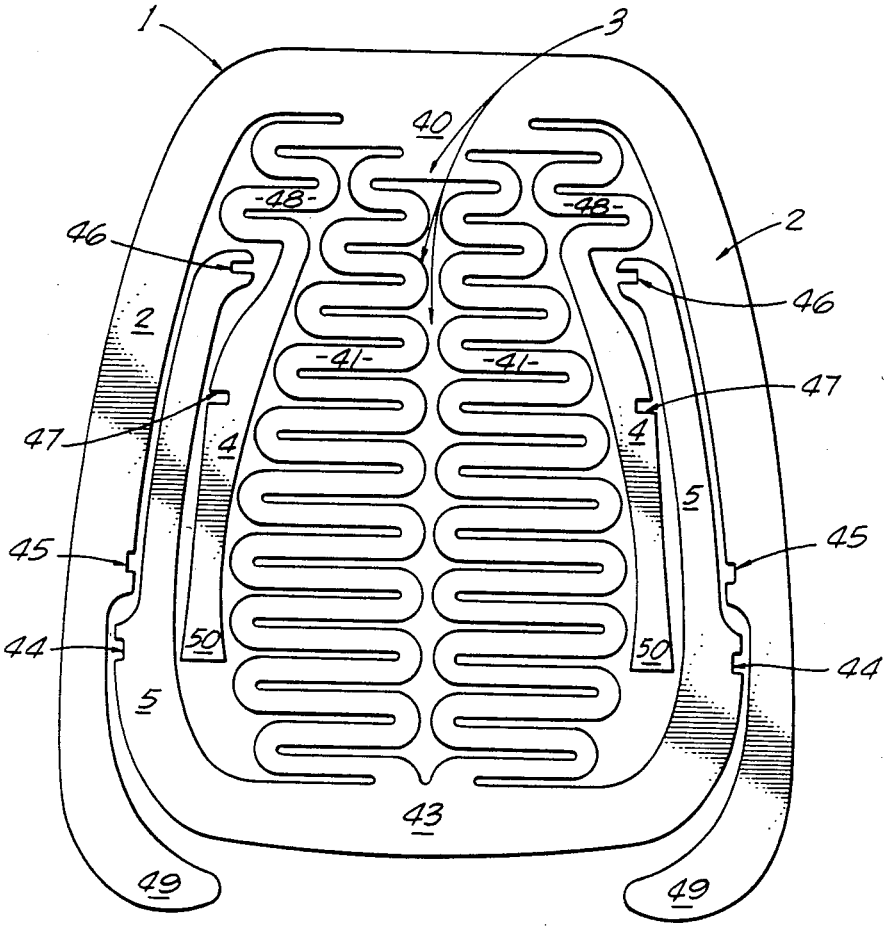
FIG. 1 is a plan view of the generally planar, one piece support member (1) having integral main (2) tab, (3) arm (5) and leg (4) portions according to the present invention.

The present invention relates to generally planar, one-piece integral support members for portable furniture, having angularly displaceable portions which provide for support systems for furniture such as chairs or tables which comprise the preferred embodiments shown in the drawings.

Figure 2:
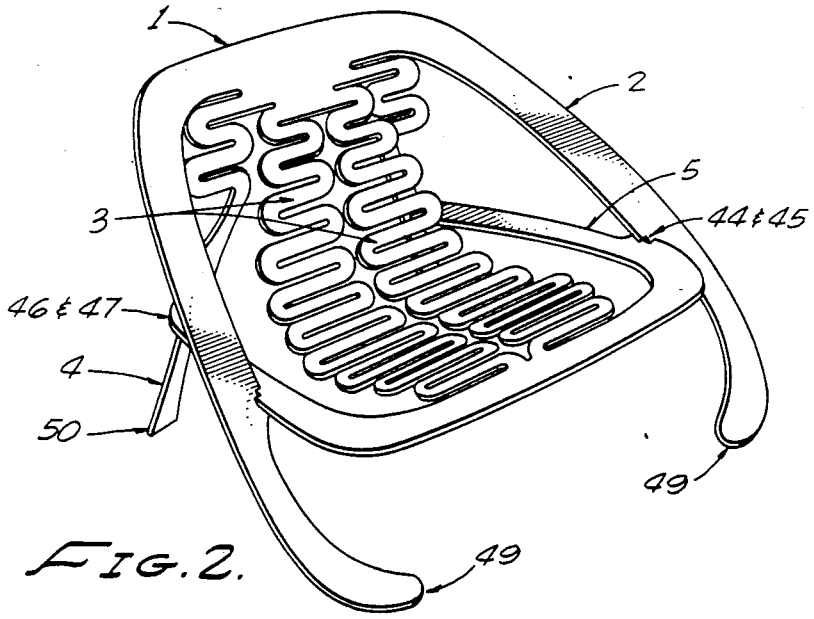
FIG. 2 is a perspective view of the assembled chair embodiment of FIG. 1.

Turning now to a detailed description of the preferred embodiment illustrated in FIGS. 1 and 2 of the drawings, FIG. 1 illustrates the generally planar one-piece support member which also encompasses a member generally analogous to the seat and back member of a chair for supporting an individual. The generally planar one-piece support member has primarily four parts, a main portion 2, a tab portion 3, leg portions 4 and arm portions 5. The tab portion 3, merges into arm portions 5 at a point generally designated by number 43, while the main portion 2 merges into leg portions 4 at point 40. While all of the members are integral with, and connected to, each other, they are resilient in nature to allow for their angular displacement into a configuration which is capable of supporting an individual. These members are held in their angular relationships through interlocking means such as notches 44 located in the arm portions 5, notches 45 located in the main portion 2, notches 46 located in the arm portion 5 and notches 47 located in the leg portions 4. The chair is held in its angularly displaced mode by the interlocking of these notches and particularly the interlocking of notches 44 with 45, and notches 46 and 47. It is noted that tab portion 3 is comprised of curvilinear loop members 41 which are flexible in nature and form the seat portion upon which the individual is seated. Because of their flexural and curvilinear nature, they are best able to conform to the configuration of the person seated thereon. It is also noted that leg portions 4 are connected to the main portion 2 via curvilinear members 48 which also allow for flexibility.

In order to assemble the chair, the tab portion 3 is pulled outwardly and up while the arm portions 5 are angularly rotated downward so as to engage notches 44 on the arm portions with notches 45 on the main portions. Main portions 2 and arm portions 5 are then flexurally displaced inwardly or outwardly to allow the notches to interlock. Thereafter, leg portions 4 are deflected rearwardly, at the same time as arm portions are deflected downwardly until notches 46 on the arm portions interlock with notches 47 on the leg portions. Once again, the flexural ability of leg portions 4 and arm portions 5 to deflect, allow for the interlocking functions to take place. Once the notches have been interlocked, the chair is now ready to accommodate the seating of an occupant and the curvilinear portions 41 and 48 allow for flexibility and comfort to the occupant.

Figure 3:
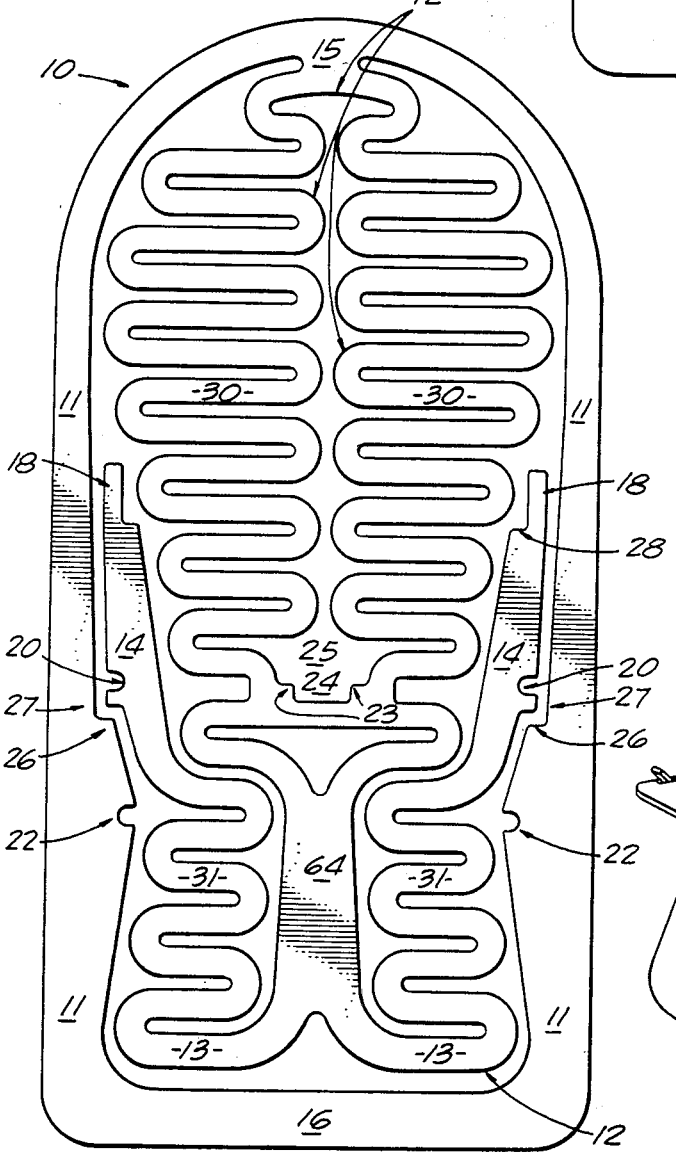
FIG. 3 is a plan view of the generally planar one-piece support member (10) comprising of integral main portion (11), tab portion (12) and arm portion (14), according to the present invention.
Figure 4:
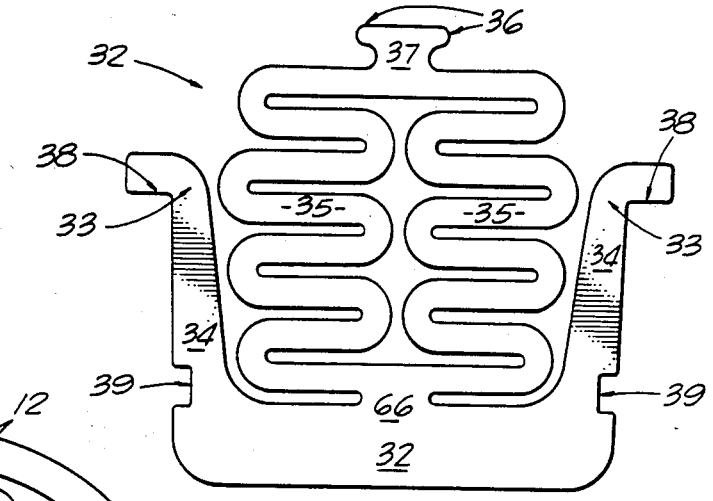
FIG. 4 is a plan view of the chair seat (32) having wings (34) and curvilinear portions (35) for use with the support member of the present invention.
Figure 5:
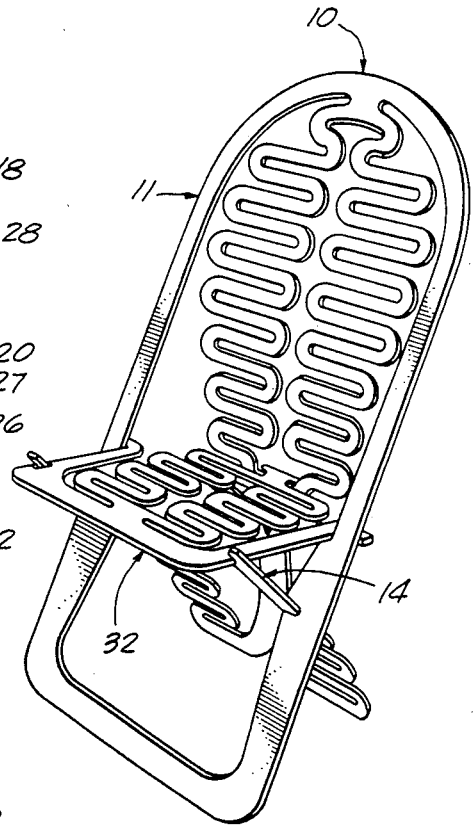
FIG. 5 is a perspective view of an assembled chair embodiment of FIG. 3.

FIGS. 3, 4 and 5 illustrate another portable chair in the preferred embodiment of the present invention, FIG. 4 illustrating the chair seat 32, FIG. 3 illustrating the support member 10 for the chair seat 32, and FIG. 5 showing the assembled version of the preferred embodiment. FIG. 3 and 4 show the portable chair embodiment and its disassembled state. It can be appreciated that the chair can be stored in its unassembled condition in a very efficient manner in a small space, while it can be assembled easily without any hinges or other complex, costly or troublesome mechanisms or apparatus.

In FIG. 3 there is shown the one-piece support member 10 comprising of an integral main portion 11, and integral tab portion 12 and an integral arm portion 14 which are adapted to be resiliently disposed in angular relation to each other. Tab member 12 and arm portions 14 are centrally disposed within main portion 11. Main portion 11 is in turn connected to tab portion 12 at point 15 while tab portion 12 is connected to the arms 14 at position 13.

The support member is comprised of a flat flexible material such as wood, plastic or metal. A suitable material is Finnish birch plywood. However, it will be obvious to one skilled in the art that other suitable materials may also be utilized in the practice of the present invention.

Planar support member 10 has various means for releasably engaging and supporting chair seat 32. Chair seat 32 is supported by the support member 10 in basically five places by arm portions 14, main portion 11, and tab portion 12.

Arm portion 14 is provided with fingers 18 and supports 28 which releasably engage and support the chair seat 32 at notches 39. Main portion 11 is, in turn, provided with support 26 which releasably engages and supports point 33 in chair seat 32. Finally, tab member 12 is provided with notch 24 having shoulders 23 where notch 24 supports seat 32 at point 37 and shoulders 23 with ears 36 of same chair seat 32.

Further, tab member 12 has a plurality of curvilinear ribs 30 and 31 formed therein which function to distribute the stress in the support member when it is disposed in angular relationship. This new chair has additional improvements over the prior art in that the length of the loops 30 which which span from notch 24 to point 15 allows them to resiliently deflect to provide for comfort as they conform to the shape of the person seated thereon. They thereafter merge into solid spine element 64 to thereafter form rear legs 13 each of which extend to comprise arm members 14 which support the front of the seat 32.

Referring to FIG. 4, there is shown a planar chair seat 32 for use with planar support member 10. The chair seat 32 is provided with curvilinear members 35 which are circumscribed by wings 34. The wings and curvilinear members are connected at point 66. Similar to the loops 30 of tab member 12, the chair seat is also provided with a plurality of generally centrally located slots and loops which define two curvilinear members or ribs 35. The present invention divorces loops 35 from wings 34 of the seat for comfort. These curvilinear members 35 act to resiliently distribute stresses as they deflect under load of the person seated thereon.

In order to assemble the chair, both arm members 14 are pulled forward and down applying inward pressure and then releasing so that notch 20 on the arms 14 on both sides of the chair engages notches 22 which are located on the main members 11. The engagement, by definition, disposes the tab member 12 in angular relation to the main portion member 11. The chair seat 32 is then positioned vertically relative to support member 10 so that the wings 34 are down and between members 11 and 12 and ears 36 are positioned opposite void 25. After the chair seat is so positioned, the chair seat is rotated so that the ears 36 are inserted into void 25 and engaged with shoulders 23. The shoulder 38 of the seat 32 contacts main member 11 of support member 10 at point 27 and chair seat points 33 are supported at point 26. Thereafter, the fingers 18 on arm portions 14 are engaged with notches 39 on chair seat 32. The chair will then sit on area 16 located in the main portion 11 of the support member 10 and rear legs 13 located in the tab portion 12 of the same support member. The chair seat will rest on supports 26 and 28 and 24 of support member 10. Loops 30 and 31 allow for angular displacement of tab member 12 and arm member 14 such that notches 20 and 22 come together and additionally loops 30 provide for confort of the chair occupant. When assembled the support member 10 is disposed in its angularly displaced mode supporting chair seat 32 which is releasably secured thereto.

Upon the application of pressure to the face of the chair seat 35, the curvilinear ribs deform inwardly in a concave manner enabling the seat to conform more closely to the profile of the individual person seated thereon making the seat more comfortable. Likewise, curvilinear ribs 30 also conform to the back of the person seated on the chair.

Figure 7:
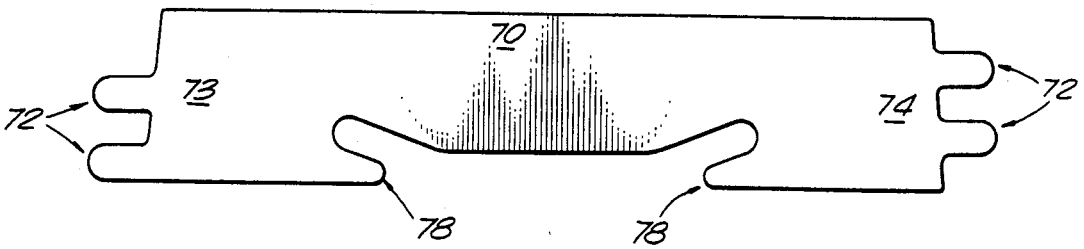
FIG. 7 is a plan view of the frame member (70) for use with the support member (19) of the present invention relating to the support of table tops.
Figure 6:
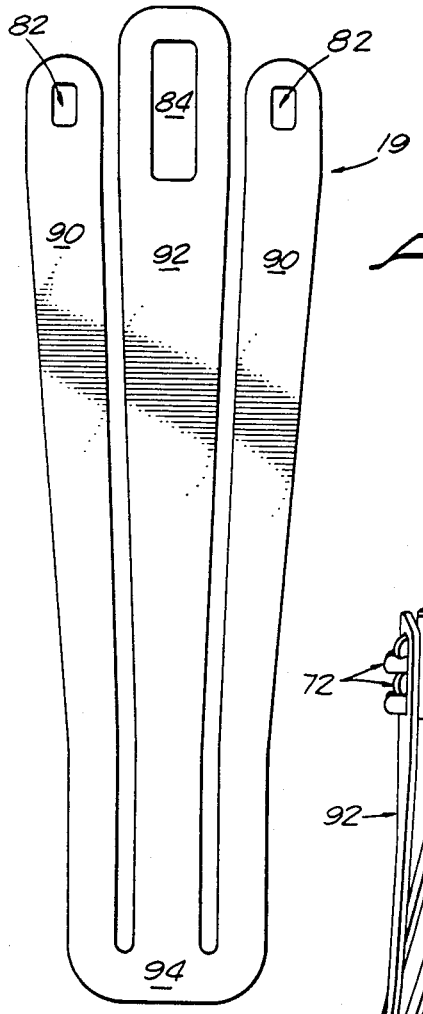
FIG. 6 is a plan view of another embodiment of the present invention, relating to support of a table, comprising of a main portion (90) and a tab portion (92).
Figure 8:
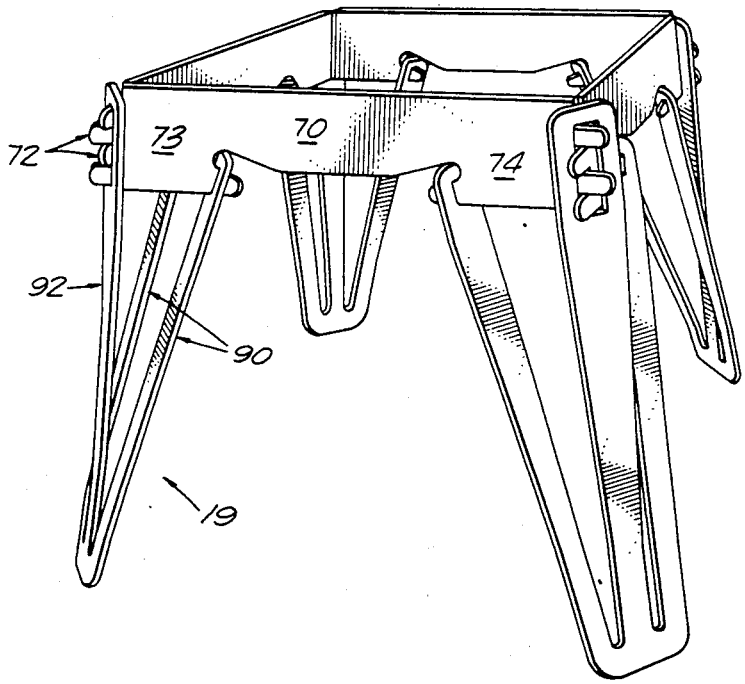
FIG. 8 is a perspective view of an assembled table top support assembly in accordance with the present invention.

Referring to FIGS. 6, 7 and 8, there is shown the preferred embodiment of a table top support formed according to the present invention. The support member 19 for the table top, is formed similar to the support member 10 for the chair having a tab member 92 integrally formed within main member 90. The tab member is provided with slot 84 which is capable of receiving tabs 72 of the frame member 70 which is shown on FIG. 7.

Referring to FIG. 6, the table top support member 19, comprises a generally planar member having a main portion 90 and a central tab portion 92 which is made to be angularly disposed from the plane of the support member at its engaged position. The tab portion and the main portions are connected at point 94 on FIG. 6. As shown on FIG. 8, the tab member 92 and main members 90 are secured at an angularly disposed position by their attachment to frame member 70 which are interlocked to each other through tabs 72.

FIG. 7 is a planar view of a typical interchangeable frame member 70 which in the present embodiment has two ends delineated by numbers 73 and 74. Tabs 72 are integral with said frame member at each end thereof and interlocked with the tabs of adjacent frame members to form a support structure for supporting a table top. The frame member shown in FIG. 7 also has projections at point 78 which in this case are disposed away from the tabs 72. These projections 78 are meant to receive slots 82 located at the end of the main portions of support member 19 while tabs 72 are meant to be engaged and supported by slot 84 on tab member 92.

To assemble the table support system, first two frame members 70 are assembled so tabs 72 are interlocked and end 74 of one frame member adjoins end 73 of an adjacent frame member. Support member 19 is then aligned so that slot 84 opposes interlocked tabs 72 of two adjacent frame members 70. Tabs 72 are thereafter inserted into slot 84, while the main portions of the support member 90 are pulled forward until slots 82 engage projections 78 of adjacent frame members. This process is repeated with the frame members until the table top support system is completed.

While embodiments and applications of this invention have been shown and described, it is apparent to those skilled in the art that many more modifications are possible without departing from inventive concepts herein described. For example, it would be obvious to one skilled in the art to provide other means to releasably secure or attach the support members to the furniture or for different configurations of tab, main members, curvilinear loops, arm members and the like. The invention, therefore, is not to be restricted except as is necessary by the prior art and by the spirit of the appended claims.

I claim:

1. Portable furniture comprising at least three planar furniture members and three planar support members, said furniture members disposed generally horizontally, and said support members disposed generally vertically in its assembled mode, said support members including integral main and tab portions of uniform thickness resiliently disposed in angular relation to one another, said furniture members having integral interlocking means for releasably engaging together and for retaining said tab portions for relative interlocking of said furniture members to one another, said furniture members having means for securing said main portions in angular relation to said tab portions, said support members adapted to return to their original planar form for portability when said interlocking means are disengaged.

2. Portable furniture comprising a table top support assembly generally formed by interlocking at least three furniture members angularly thereto and then engaging a support member to each resultant corner, each support member including integral main and tab portions of uniform thickness resiliently disposed in angular relation to one another, each furniture member having projecting tabs at each end, which interdigitize with the tabs of an adjacent furniture member and interlock with the tab portion of said support members, each furniture member also having securing means disposed on its bottom edge, away from said projecting tabs, for engaging with the main portions of said support members to maintain said angular relation, said support members and said furniture members being selectively separable for portability by disengaging said interlocking means.

3. Portable furniture comprising, in its unassembled form, at least three originally planar uniformly thick support members and at least three originally planar uniformly thick frame members, said support members comprising a basically "U" shaped main portion with a central tab portion integrally connected to the bottom thereof, and having slots at the top end of said main and tab portions thereof, said frame members comprising basically linear elements with projecting tabs at each end adapted to engage with one another and having two projections located on the bottom edge thereof disposed somewhat away from said ends.

* * * * *